United States Patent [19]

Robbins et al.

[11] 4,334,685

[45] Jun. 15, 1982

[54] THREE DICE WAGERING GAME

[76] Inventors: Anthony Robbins, 1801 S. Dixie Hwy., Lot 207, Pompano Beach, Fla. 33060; Omero C. Catan; Jeanne Catan, both of 1901 S.W. 87 Terr., Fort Lauderdale, Fla. 33324

[21] Appl. No.: 155,101

[22] Filed: Nov. 20, 1980

[51] Int. Cl.[3] ..... A63F 9/04

[52] U.S. Cl. ..... 273/274

[58] Field of Search ..... 273/274

[56] References Cited

U.S. PATENT DOCUMENTS 3,399,897 9/1968 Mitchell ..... 273/274 X 4,247,114 1/1981 Carroll ..... 273/274

*Primary Examiner*—Anton O. Oechsle

*Attorney, Agent, or Firm*—Omero C. Catan

[57] ABSTRACT

A playing surface includes seven Rows which are so demarcated by a line directed from the top to the bottom of said surface as to render each Row into two sections. The area now at the left is identified by indicia explaining in detail the co-related area's purpose immediately to its right which is the betting area. Five of such betting areas on said right side are further divided into a plurality of betting stalls, each stall having two components. One component, at the upper part thereof has indicia showing the betting 'number' and the other component at the lower part thereof has indicia showing the odds offered thereon. The remaining two betting areas on the right side is not divided but is emblazoned with indicia showing the type of bet therein and flanked on each side of the emblazonment with the odds offered therein. The combinations and permutations probability of the simultaneous ONE THROW OF THREE DICE (two WHITE dies and one RED die) which immediately completes each game has an indirect bearing on the odds shown in the plurality of betting areas. A plurality of various colored betting chips are adapted to be selectively placed on the various betting units. However, each player must have a different identifying colored stack of chips from each of the other players and must be 'payed-off' in the same like-colored chip the bet was made with, which of course, coincides with the color of the stack of chips presently in front of the player.

2 Claims, 1 Drawing Figure

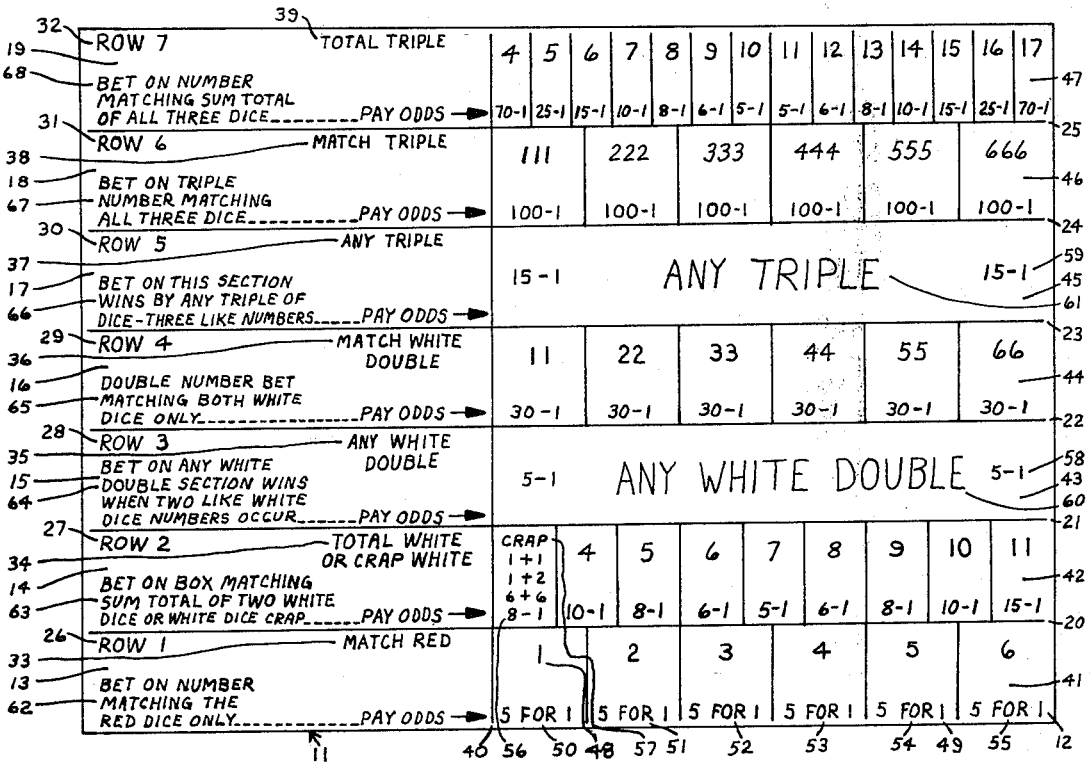

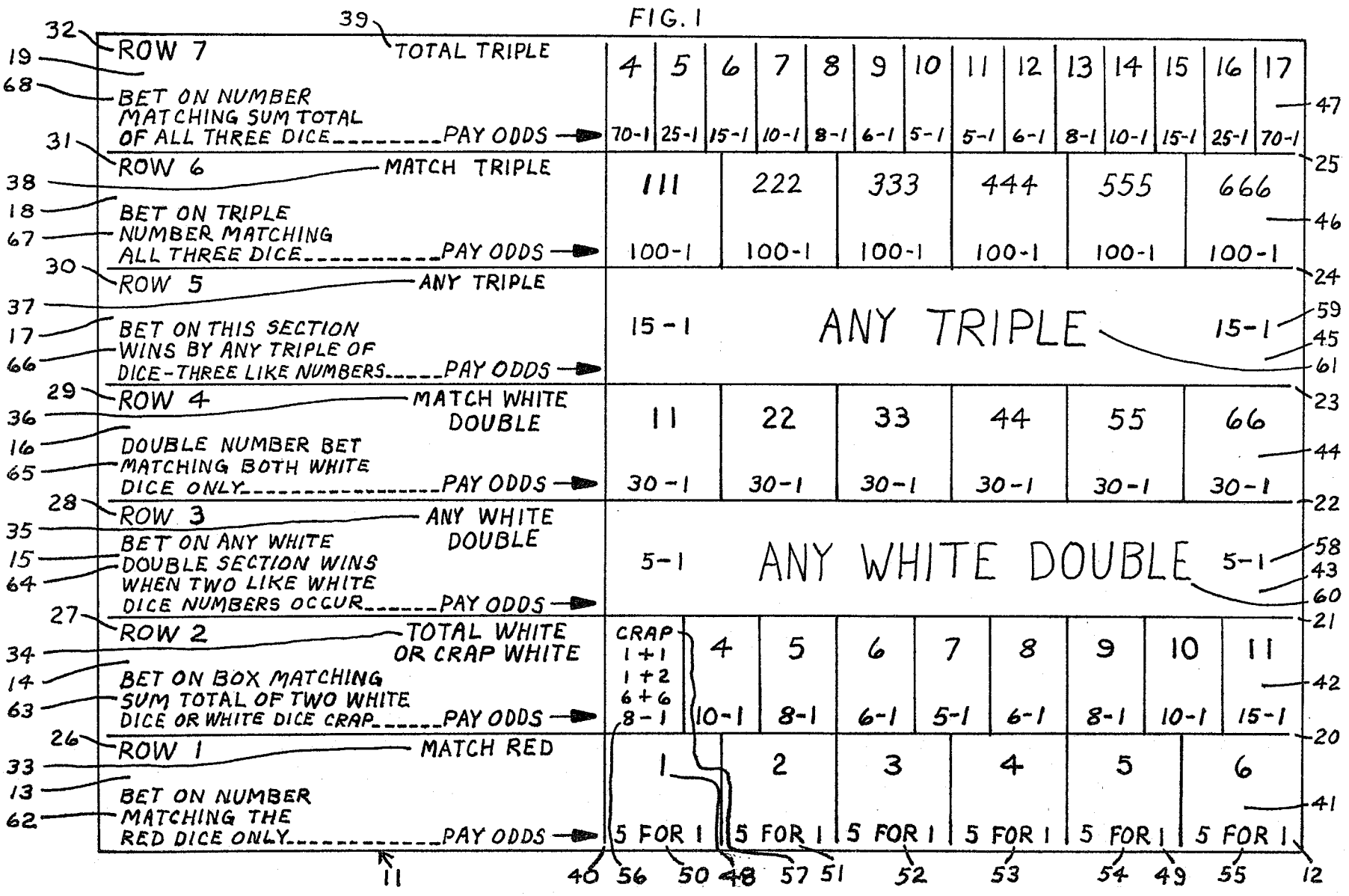
FIG. 1
ROW 7
BET ON NUMBER MATCHING SUM TOTAL OF ALL THREE DICE
TOTAL TRIPLE
PAY ODDS
4 5 6 7 8 9 10 11 12 13 14 15 16 17
70-1 25-1 15-1 10-1 8-1 6-1 5-1 5-1 6-1 8-1 10-1 15-1 25-1 70-1
ROW 6
BET ON TRIPLE NUMBER MATCHING ALL THREE DICE
MATCH TRIPLE
PAY ODDS
111 222 333 444 555 666
100-1 100-1 100-1 100-1 100-1 100-1
ROW 5
BET ON THIS SECTION WINS BY ANY TRIPLE OF DICE-THREE LIKE NUMBERS
ANY TRIPLE
PAY ODDS
15-1 ANY TRIPLE 15-1
ROW 4
DOUBLE NUMBER BET MATCHING BOTH WHITE DICE ONLY
MATCH WHITE DOUBLE
PAY ODDS
11 22 33 44 55 66
30-1 30-1 30-1 30-1 30-1 30-1
ROW 3
BET ON ANY WHITE DOUBLE SECTION WINS WHEN TWO LIKE WHITE DICE NUMBERS OCCUR
ANY WHITE DOUBLE
PAY ODDS
5-1 ANY WHITE DOUBLE 5-1
ROW 2
BET ON BOX MATCHING SUM TOTAL OF TWO WHITE DICE OR WHITE DICE CRAP
TOTAL WHITE OR CRAP WHITE
PAY ODDS
CRAP 1+1 1+2 6+6 8-1
4 5 6 7 8 9 10 11
10-1 8-1 6-1 5-1 6-1 8-1 10-1 15-1
ROW 1
BET ON NUMBER MATCHING THE RED DICE ONLY
MATCH RED
PAY ODDS
1 2 3 4 5 6
5 FOR 1 5 FOR 1 5 FOR 1 5 FOR 1 5 FOR 1 5 FOR 1
12 11 13 14 15 16 17 18 19 20 21 22 23 24 25 26 27 28 29 30 31 32 33 34 35 36 37 38 39 40 41 42 43 44 45 46 47 48 49 50 51 52 53 54 55 56 57 58 59 60 61 62 63 64 65 66 67 68

THREE DICE WAGERING GAME

MOTIVATION OF THE INVENTION

The present invention entitled "THREE DICE WAGERING GAME" is directed toward a table game and more particularly toward a game of chance employing dice which is intended to be played in gambling casinos, but which is also practical as a game of entertainment and excitement during travel, on a beach or picnic or at home in the living room.

With the relatively recent mushrooming of gambling casinos in the United States and the obvious unsatiable gambling urges of the patrons therein, the need for a simplistic game of chance to appease and please ALL STRATA of expertise in the art of gambling has become more apparent.

SUMMARY OF THE INVENTION

The present invention is believed to satisfy these needs by providing a game of chance so simple in form that people of every level of intellect can quickly and sagaciously place a bet or a simultaneously plurality of bets thereon. This is accomplished by having a portable or permanent table, material or flat structure imprinted or painted with indicia of an explanatory and enumerated nature in seven horizontal rows. Each row is further divided into two sections from left to right. On the left section of each row is an simple explanation of the three dice fall bet in relation to the section or the subsections immediately to its right which are the betting areas. A plurality of betting chips are adapted to be selectively placed on the betting areas.

BRIEF DESCRIPTION OF THE GAME

One throw of the three dice—TWO WHITE and ONE RED—completes game. In addition to the three dice, required are at least nine stacks of chips. Each stack of chips to be of a different color. A pocketless billiard type table with matted sides to receive the impact of the throw of the dice is ideal. In lieu of the actual throwing of dice, a cage contraption in which the dice can be flipped over and still remain entrapped can be used. The "THREE DICE WAGERING GAME" drawing could be painted on the table or on plastic, canvass, cloth or wood scaled in size to fit table. A croupier's retrieving cue is useful. Finally, only one personnel is needed as the banker.

BRIEF DESCRIPTION OF THE DRAWING

For the purpose of illustrating the invention, there is shown in the accompanying drawing the form which is presently preferred; it being understood that the invention is not intended to be limited to the precise arrangements shown nor to the instrumentalities mentioned or implied above.

FIG. 1 is a perspective view of the table game constructed in accordance with the principles of the present invention.

DETAILED DESCRIPTION OF THE PREFERRED EMBODIMENT

Referring now to the drawing in detail wherein like reference numerals have been used throughout the various figures to designate like elements, there is shown in FIG. 1 a table game constructed in accordance with the principles of the present invention and designated generally as 11. Table game 11 has a top-side playing surface 12 thereon. Playing surface 12 is divided into a plurality of areas 13–19.

Three conventional cubes (six-sided dice) having indicia on the faces thereof representing the numbers 1 thru 6 respectively are provided for play. The three dice, however, are not all the same color. Two dice are white and one dice is red. The dice per se are of such common usage and so widely renown, it is not believed necessary to detail the instrumentality.

The plurality of areas 13–19, which is directed horizontally in pattern, is separated by a solid line 20–25 running horizontally from one end of the table's playing surface 12 to the other end. These areas are further identified on the playing surface 12 by the title "ROW"; ergo, Rows 1 thru 7 respectively 26–32. Further, the rows 13–19 are divided into two sections by a vertical line 40 running from the top to the bottom of the playing surface 12.

The sections on one side of line 40 contain a plurality of data among which is the title of the wager 33–39 in relation to the betting areas 41–47 on the opposite respective sides. It further elucidates in concise simple language the exact nature of the wager and the odds it will pay 62–68. Betting area 41 is divided into a plurality of 6 stalls 50–55. Each stall is further divided into two components. For example, stall 50 has an upper part 48 which is the number bet and a lower part 49 which are the odds offered. Betting areas 42, 44, 46 and 47 are also divided into a plurality of stalls substantially identical in format to stall 50 and accordingly a detailed description thereof is not believed necessary. However, while stall 56's lower part is similar to stall 50, which state the odds offered, the upper part of 56 is exceptional in that there are three betting combinations offered for the same wager under the word 'crap' 57.

Betting areas 43 and 45, having no stalls, have the betting odds stated at both sides of said areas 58 and 59. In addition, betting areas 43–45 has emblazoned thereon the type of wager applicable 60–61 which coincides with the title of the wager 35 and 37.

The rules detailed below for the playing of this table game entitled "THREE DICE WAGERING GAME" are clear, concise and simple. It is intended the game be played in the manner to be now described. The following description will make specific reference to FIG. 1. One person (personnel) is needed as the banker. It is suggested the banker have available an abundant supply of chips in at least nine different solid colors.

A player or any number of players can play simultaneously. Ideally, the maximum of comfort and pleasure is attained with nine players. When placing wagers chips must be used. Therefore, each of the players must first purchase a plurality of chips, in several denominations if they so desire, but all must be of the same color. Of necessity, a player must have a distinctive colored chip from all other players so as the chips may easily be identified as that of said player, its owner, when a plurality of chips are on the betting areas 41–47. When collecting a winning bet, a player will receive chips of the same color said player is using.

A wager is made by a player placing a chip or a plurality of chips on any marked segment of the betting areas 41–47. For example, among other players, a player may place a chip on the number "10" in Row 7, 32 and another chip on number "8" in Row 2, 27 and still another chip on "ANY TRIPLE" 61 in Row 5, 30. After all wagers or bets are placed, the banker or a player will throw the three dice simultaneously permissibly over the areas 13–19 just forcibly enough to make impact against the rise or abutment adjacent thereto. In lieu of actually throwing the dice, a cage contraption, in which the dice can be flipped over and still remain entrapped, may also be used. The one simultaneous throw of the three dice—TWO WHITE DIES and ONE RED DIE—completes the game.

The result of the aforementioned throw of the dice produced a showing on the faces thereof of a 'four' on both white dies and a 'two' on the red die. Therefore, the player, in the example above, who made three bets did meet the criteria in winning two of them. The player won the Row 7, 32 bet because the chip was on '10' with a 'TOTAL TRIPLE' 39 (4+4+2=10) and received '6' chips for this bet as the odds 68 were five to one. The same player collected seven chips for the bet made in Row 2, 27 because the odds 63 were six to one and met the criteria to win by a 'TOTAL WHITE' 34 (white 4+white 4=8). He did not collect on his third wager made in the same game for he failed to meet the winning criteria of Row 5, 30 which called for 'ANY TRIPLE' 37 since the face of all three dice did not show three like numbers 66.

The foregoing is considered as illustrative only of the principles of the invention. Further, since numerous modifications and changes nay occur to those skilled in the art, it is not desired to limit the invention to the exact construction and operation shown and described, and accordingly all suitable modifications and equivalents may be resorted to, falling within the scope of the invention as claimed.

We claim:

1. In a new table game of chance device:

game having a table surface comprised of fourteen rectangular areas or spaces with said spaces being arrayed into two groups of seven spaces each with one of the two being adjacent to the other group directed from the top to the bottom of the playing surface and, further, a black line running in a vertical direction, directed from the top of the playing surface to te bottom thereof, demarcates the one group of spaces from the second group;

each space of the group of seven spaces on the left side is co-related to its counterpart space of the group of seven spaces at its right side, the area or space at the left having indicia thereon explanatory in nature as to the type of bet available or offered when a bet is placed on its counterpart space which is the actual betting area at its right, and further, the spaces at the left having, among other things, indicia thereon specifically identifying and attaching itself as being indigenous to the space at the right by the title ROW, ergo, Rows 1 thru 7 are comprised of all of the fourteen areas of the playing surface, however, while the left areas of Rows 1 thru 7 are essentially identical in format the right side or betting areas of Rows 1 thru 7 are not all alike in format since Rows 1, 2, 4, 6 and 7 are comprised of a plurality of betting stalls divided into two components each, the upper component representing the 'number ' bet and the lower component stating the odds offered and the betting areas of Rows 3 and 5 respectively having the center spaces therein emblazoned with the type of bet and, at either side thereof, the odds offered, and three dice, each of said dice having six surfaces with indicia thereon identifying the faces with a different one of the numbers one to six, two of said dice being white in color and the third dice being red in color, and in each game which consists only of one throw of all three dice simultaneously, the total of all three dice's numbers facing skywards is represented by Row 7, and, further, if the numbers on the three dice are alike Row 5 and Row 6 are also represented, further, and still pertaining to the same throw and game, the two white dice are represented in tandem or collectively in Rows 2, 3, and 4 respectively, still further, the red dice is represented in Row 1, again, in the same throw and game.

2. A table game of chance as claimed in claim 1 further including a plurality of betting areas in Rows 1, 2, 4, 6 and 7, and a single betting area in Rows 3 and 5 with the color of the playing surface and the indicia thereon being optional since the color of said playing surface and the indicia thereon is not instrumental in play.

* * * * *